US006266510B1

(12) United States Patent
Curry et al.

(10) Patent No.: US 6,266,510 B1
(45) Date of Patent: Jul. 24, 2001

(54) CONTROL OF WRINKLING IN BELT FUSER BY NIP CONFIGURATION

(75) Inventors: Steven A. Curry, Lexington; Keith Seaman, Richmond, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/664,956

(22) Filed: Sep. 18, 2000

(51) Int. Cl.[7] ..... G03G 15/20
(52) U.S. Cl. ..... 399/329
(58) Field of Search ..... 399/329, 333, 399/322, 331, 332; 219/216

(56) References Cited

U.S. PATENT DOCUMENTS

| | | | |
|---|---|---|---|
| 3,884,623 | 5/1975 | Sikes, Jr. et al. | 432/60 |
| 3,999,038 | 12/1976 | Sikes, Jr. et al. | 432/60 |
| 4,008,955 | 2/1977 | Bar-on | 355/3 R |
| 4,042,804 | 8/1977 | Moser | 219/216 |
| 4,253,392 | 3/1981 | Brandon et al. | 100/155 R |
| 4,594,068 | 6/1986 | Bardutzky et al. | 432/60 |
| 4,693,587 | 9/1987 | Shigenobu et al. | 355/3 FU |
| 4,803,877 | 2/1989 | Yano | 72/248 |
| 4,814,819 | 3/1989 | Torino et al. | 355/3 FU |
| 4,870,731 | 10/1989 | Yano | 29/116.1 |
| 4,872,246 | 10/1989 | Yano | 29/116.1 |
| 4,930,202 | 6/1990 | Yano | 29/116.2 |
| 4,961,704 | 10/1990 | Nemoto et al. | 219/216 |
| 5,195,430 | 3/1993 | Rise | 100/168 |
| 5,210,579 | 5/1993 | Setoriyama et al. | 355/285 |
| 5,345,301 | 9/1994 | Satoh et al. | 355/290 |
| 5,355,204 | 10/1994 | Aoki | 355/285 |
| 5,450,181 | 9/1995 | Tsukida et al. | 355/282 |
| 5,655,201 | 8/1997 | Islam et al. | 399/322 |
| 5,666,624 | 9/1997 | Kanesawa et al. | 399/329 |
| 5,689,789 | 11/1997 | Moser | 399/331 |
| 5,742,878 | 4/1998 | Kuroda | 399/122 |
| 5,866,875 | 2/1999 | Okabayashi | 219/216 |
| 5,999,788 | 12/1999 | Kanesawa et al. | 399/329 |

*Primary Examiner*—Quana M. Grainger
(74) *Attorney, Agent, or Firm*—John A. Brady

(57) ABSTRACT

An electrophotographic printing apparatus utilizing a belt fuser mechanism which minimizes or eliminates the wrinkling or "treeing" of printed pages through the fuser is disclosed. In this device, the belt fuser apparatus is configured such that, as the printed page moves through the fusing nip, it is subjected to a lateral force from the center of the nip toward the ends of the nip, which is normal to its direction of travel through the nip. One way of achieving this is to utilize a concave heater frame and a substantially cylindrical backup roller such that the nip formed when these two components are pressed together, is essentially saddled-shaped. In such a nip, the velocity of the printed page through the nip is greater at the ends of the nip than in the middle of the nip, thereby providing the force which acts to stretch the page from the center of the page out towards its edges, thereby minimizing wrinkling or "treeing".

9 Claims, 3 Drawing Sheets

CONTROL OF WRINKLING IN BELT FUSER BY NIP CONFIGURATION

TECHNICAL FIELD

The present invention relates to electrophotographic processes and, particularly, to the minimization of wrinkling of printed pages as they are fed through a fuser belt in the printing process.

BACKGROUND OF THE INVENTION

In electrophotography, a latent image is created on the surface of an insulating, photoconducting material by selectively exposing an area of the surface to light. A difference in electrostatic density is created between the areas on the surface exposed and those unexposed to the light. The latent electrostatic image is developed into a visible image by electrostatic toners containing pigment components and thermoplastic components. The toners, which may be liquids or powders, are selectively attracted to the photoconductor's surface either exposed or unexposed to light, depending upon the relative electrostatic charges on the photoconductor's surface, development electrode and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor's surface, pulling the toner from the photoconductor's surface onto the paper or intermediate medium still in the pattern of the image. A set of fuser rolls or belts, under heat, melts and fixes the toner in the paper subsequent to transfer, producing the printed image.

The electrostatic printing process, therefore, comprises an intricate and on-going series of steps in which the photoconductor surface is charged and discharged as the printing takes place. In addition, during the process, various charges are formed on the photoconductor surface, the toner and the paper surface to enable the printing process to take place. Having the appropriate charges in the appropriate places, at the appropriate times is critical to making the process work.

After the image is transferred to the paper or other recording medium, it goes to the fuser where the paper is moved through a nip where it is heated and pressed. This melts the thermoplastic portion of the toner, causing it to bond with the fibers of the paper, thereby fixing the image onto the paper or recording medium. While this is an effective way of fixing the toner image on the paper's surface, it carries with it some problems. A common problem with fusing mechanisms is the creasing or "treeing" of the print media as it passes through the fuser nip. Several factors, including environment, relative humidity, media type, entry conditions, and nip mechanics, can affect the tendency of a fuser to tree media. Regardless of the cause, creased, wrinkled or "treed" pages result in lost time, lost paper, and lost patience, as printing operations have to be repeated over again in order to get a non-creased product. While the issue of wrinkling, creasing and treeing has been addressed extensively in the fuser roll context, because the mechanics are different and somewhat more intricate, it has not been addressed extensively in the context of a belt fuser mechanism.

U.S. Pat. No. 5,355,204, Aoki, issued Oct. 11, 1994, describes a mechanism which is said to minimize creasing of the belt in a belt fuser mechanism. A creased fuser belt (as opposed to creased print media) is said to result in uneven fusing of the print media. The desired result is accomplished by crowning the heater (i.e., forming a convex surface on the heater) and inversely crowning (i.e., forming a complimentary concave surface) the backup roll such that they fit together. It will be noted that this is the opposite approach of the present invention in which it is important to form a concave surface on the heater and, therefore, on the fuser belt.

U.S. Pat. No. 5,450,181, Tsukida, et al., issued Sep. 12, 1995, which provides a fixing roller mechanism which is said to minimize print media wrinkling without forming corrugated edges on the printed page. The described device utilizes a fixing roller which basically has an inverse crown (i.e., concave) shape, but which moves the largest roller diameter in from the ends of the roll toward the center (see FIG. 3 of the patent). The entire focus of the structure is to avoid stretching the edges of the print media in order to avoid corrugation of the printed page.

U.S. Pat. No. 4,042,804, Moser, issued Aug. 16, 1977, describes a fuser roll mechanism which is said to minimize paper wrinkling. The fuser roll is structured such that the printed page moves through the fusing nip faster at its edges than at its center. The core of the fuser roll has a smaller diameter at its center than at its edges (i.e., a concave structure). An elastomeric outer layer is placed on the fuser roll core such that the finished roll has a uniform diameter across its length (i.e., the elastomeric layer is thicker at the center than at its ends). Thus, the overall structure of the roll itself is cylindrical, not concave.

U.S. Pat. No. 3,884,623, Slack, issued May 20, 1975, describes a fuser roll which is tapered in its diameter from its ends towards its center (i.e., a concave structure). This structure is said to minimize wrinkling in the printed pages produced.

U.S. Pat. No. 4,594,068, Bardutzky, et al., issued Jun. 10, 1986, describes a fuser roll structure which utilizes a concave-shaped roll core and a complimentary elastomeric coating, which is thicker in the middle and thinner at the ends of the roll, such that the overall coated fuser roll is uniform in diameter along its length. This roll structure is said to result in a higher through-put speed for the printed page at the roll ends than at the roll center, thereby stretching the printed page and minimizing wrinkling.

U.S. Pat. No. 5,195,430, Rise, issued Mar. 23, 1993, describes a fuser roll structure which is said to eliminate flexing of the fuser roll during use, thereby avoiding uneven fixing of the printed page. The patent teaches that crowning of fuser rollers is undesirable since it leads to wrinkling of the printed pages because of the velocity differences at various points along the fusing nip. This patent addresses this issue by utilizing a fixing roller having a metallic roller core which is crowned at the center (i.e., a convex shape); the roller is covered with an elastomeric material which is thinner at the middle than at the ends of the roll such that the overall diameter of the roll across its length is constant. This structure is said to minimize roller flexing and paper wrinkling.

U.S. Pat. No. 4,961,704, Nemoto, et al., issued Oct. 9, 1990, describes a mechanism for minimizing meandering of the printed page through the fuser nip, particularly when the printer is starting up. This is said to be accomplished by utilizing a fuser roller which allows the user to change the end pressure of the roller as needed, starting with higher pressures at the ends of the rollers. This pressure differential changes the velocity of the paper at various points along the nip, thereby keeping the paper moving through the nip straight.

U.S. Pat. No. 4,930,202, Yano, issued Jun. 5, 1990, describes fixing rollers which have a non-uniform diameter across their length; the rollers either crown at their center or at their ends. The shaft through the roller is bent to parallel the surface shape of the roller. This structure is said to decrease paper wrinkling and bending of the roller shaft during use.

U.S. Pat. No. 4,872,246, Yano, issued Oct. 10, 1989, describes fixer rolls which have a larger diameter at their ends than at their center (i.e., the rolls have a concave shape). The roll body is utilized on a curved shaft and this structure is said to minimize wrinkling of the printed page. See also, U.S. Pat. Nos. 4,803,877 and 4,870,731.

U.S. Pat. No. 3,999,038, Sikes, Jr., et al., issued Dec. 21, 1976, describes a fuser roll having an hour-glass shape (i.e., a concave structure) wherein the diameter of the ends of the roll is larger than the diameter of the center of the roll. This structure is said to reduce wrinkling of the printed page, especially in duplex operations. The patent suggests that the mechanism of action is that the paper velocity through the fusing nip is greater at the ends of the roll than at the middle of the roll, thereby stretching out any wrinkles formed.

U.S. Pat. No. 4,008,955, Bar-on, issued Feb. 22, 1977, describes a fuser roll structure which is said to minimize wrinkling of the printed pages formed. This is accomplished by placing rings at the ends of the backup roller, rather than on the fuser roller. When this backup roller is used in combination with a cylindrical fuser roll, the velocity of the paper through the nip at the ends of the nip is said to be greater than the velocity at the center of the nip, thereby minimizing wrinkling of the printed page.

U.S. Pat. No. 4,253,392, Brandon, et al., issued Mar. 3, 1981, describes a fuser roll having adjustable ends which allow the end diameter of the roll to be increased relative to the center diameter. In high humidity conditions, the roll can be made concave by increasing the diameters of the roll ends, which is said to eliminate wrinkling of printed pages moving through the nip. In low humidity conditions, the adjustable ends are used to make the roll cylindrical, thereby eliminating the smearing problem which is said to occur with concave fuser rolls.

U.S. Pat. No. 5,689,789, Moser, issued Nov. 18, 1997, describes a fuser roll configuration the purpose of which is to create a constant nip velocity across the length of the nip. This is said to be accomplished by crowning the fuser roller (i.e., making it thicker in the middle than on the ends; a convex structure) so that it forms a uniform nip thickness when compressed against the backup roller in use. This approach is the opposite of many of the other prior art references and of the present invention, the entire purpose of which is to create velocity differentials for the printed page at various points in the nip.

U.S. Pat. No. 5,655,201, Islam, et al., issued Aug. 5, 1997, describes a fuser roll structure which is used to fuse migration imaging members, rather than paper. The fixing roller is structured such that it contacts the backup roller only at its edges in order to minimize stresses at the middle of the roll.

The prior art, discussed above, does not suggest the use of a concave fuser belt or present any approach to the issue of minimizing wrinkling of the printed page in a fuser belt context. The art clearly recognizes that the minimization of printed page wrinkling in a fuser roll system is desirable. This is addressed by the prior art, in fuser roll systems, by variously forming concave fuser rolls, convex fuser rolls, and perfectly cylindrical fuser rolls (i.e., by modifying the driven nip member). Further, while some of the art suggests that formulating a fuser roll system such that a higher paper velocity at the ends of the roll rather than the middle of the roll is desirable, some of the art suggests that what is required is a uniform paper velocity across the entire nip. The bottom line is that the prior does not teach or suggest a solution for the problem of paper wrinkling in a fuser belt system.

It has now been discovered that by using a fuser belt system which is configured such that the printed page moves through the nip at a speed which is greater at the ends of the nip than at the center of the nip, wrinkling of the printed page is avoided. Specifically, this can be achieved by utilizing a concave heater frame to hold the heater, thereby giving the fuser belt in use a concave shape (i.e., by modifying the non-driven nip member), together with a substantially cylindrical backup member. This results in a saddle-shaped fuser nip which provides the desired velocity differential. The invention is described in greater detail below.

SUMMARY OF THE INVENTION

The present invention encompasses an image-fixing apparatus comprising:

- a heater which is stationary in use;
- a film slideable on said heater;
- a backup member which cooperates with said heater to form a nip with said film being interposed between said backup member and said heater, wherein an image carried on a recording medium is heated through said film while in the nip by heat from said heater;
- wherein said nip is configured such that as the recording medium moves through the nip it is subjected to a lateral force, from the center of the nip towards the ends of the nip, which is normal to its direction of travel through the nip.

The basic objectives of the present invention can be achieved by formulating the image-fixing apparatus such that the fuser belt nip is configured such that the velocity of the recording medium (i.e., the printed page) through the nip is greater at the ends of the nip than at the center of the nip thereby providing the defined lateral force. In a specific embodiment, the heater for the fuser belt is held in a concave heater frame and the backup member is a cylindrical roller which has a substantially uniform diameter across its length. In this embodiment, when the nip is formed between the heater frame and the backup roller, with the fusing belt interposed between them, it has a substantially saddle shape such that the velocity of the recording medium through the nip is greater at its ends than at its center.

DETAILED DESCRIPTION OF THE INVENTION

The present invention relates to an apparatus and a method for minimizing the wrinkling of printed pages moving through a belt fuser in an electrophotographic printer. By designing the belt fuser and configuring the fuser nip such that, as the recording medium moves through the nip, it is subjected to a lateral force from the center of the nip outwards toward the ends of the nip, which is normal to its direction of travel through the nip, such wrinkling can be avoided. Specifically, in a preferred embodiment, the fuser belt mechanism utilizes a concave heater and frame assembly against which the fuser belt is pushed by a substantially cylindrical backup member to form the fusing nip. This nip will have a substantially saddle shape (i.e., wider at the ends than in the middle) wherein the velocity of the printed page through the nip is greater at the ends of the nip than at the center of the nip, thereby providing the required lateral normal force.

Figure 1:
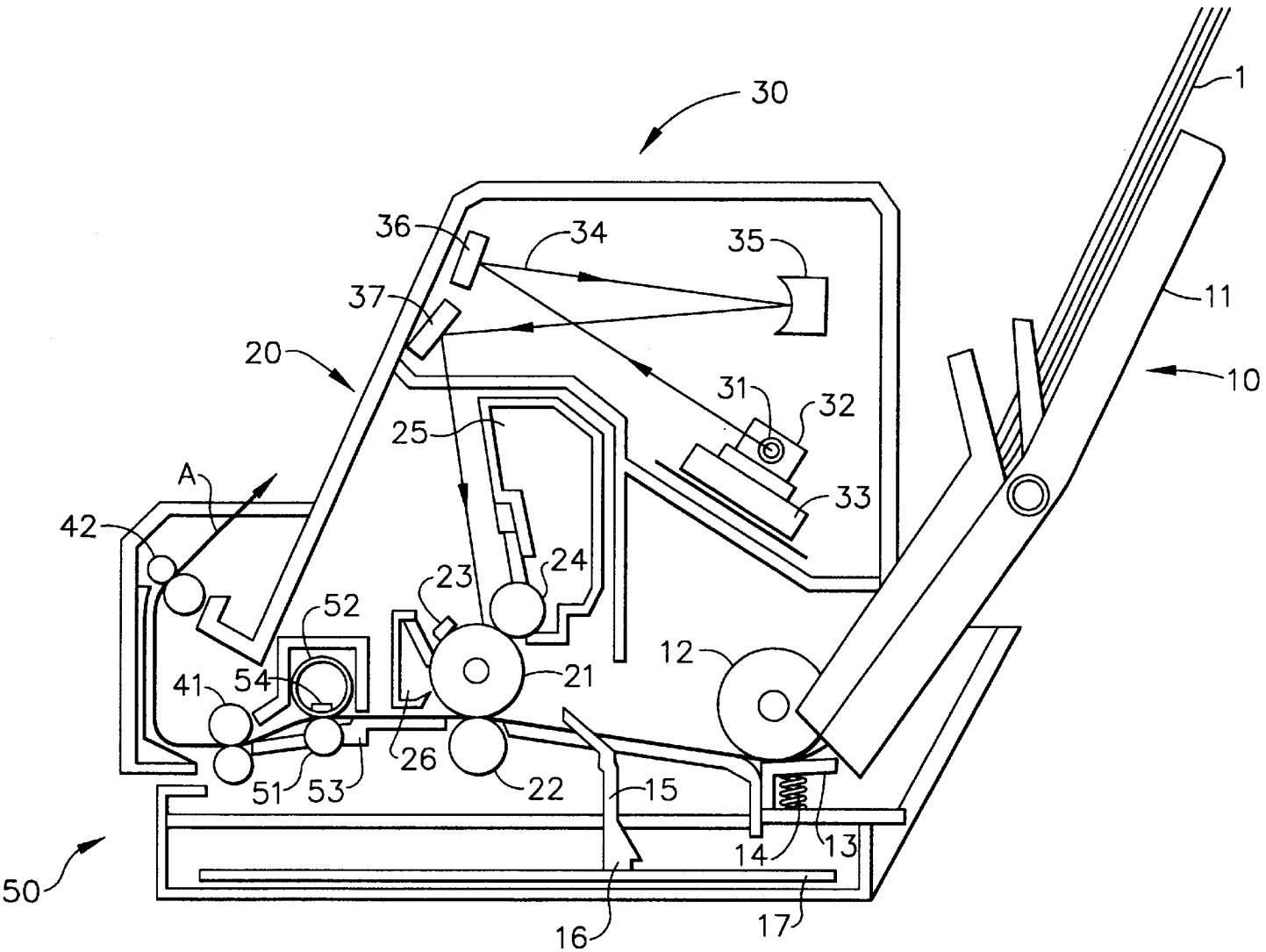
FIG. 1 is a schematic view of a laser printer representing a typical electrophotograpic apparatus, particularly one used in a desktop printer or copier.

A standard design for a laser printer, a representative electrophotographic device, is shown in FIG. 1. It includes a paper feed section (10), an image-forming device (20), a laser scanning section (30), and a fixing device (50). The paper feed section (10) sequentially transports sheets of recording paper (or other printing media) (1) to the image-forming device (20) provided in the printer. The image-forming device (20) transfers a toner image to the transported sheet of recording paper (1). The fixing device (50) fixes toner to the sheet of recording paper (1) sent from the image-forming device (20). Thereafter, the sheet of recording paper (1) is ejected out of the printer by paper transport rollers (41, 42). In short, the sheet of recording paper (1) moves along the path denoted by the arrow (A) in FIG. 1. It is to be understood that, as used herein, the terms "recording paper" or "paper" are intended to include any and all recording/printing media which may be fed through an electrostatic printer (e.g., paper, transparencies, labels, envelopes, note paper).

The paper feed section (10) includes a paper feed tray (11), a paper feed roller (12), a paper separating friction plate (13), a pressure spring (14), a paper detection actuator (15), a paper detection sensor (16), and a control circuit (17).

Upon receiving a print instruction, the sheets of recording paper (or other printing media) (1) placed in the paper feed tray (11) are fed one-by-one into the printer by operation of the printer feed roller (12), the paper separating friction plate (13) and the pressure spring (14). As the fed sheet of recording paper (1) pushes down the paper detection actuator (15), the paper detection sensor (16) outputs an electrical signal instructing commencement of printing of the image. The control circuit (17), started by operation of the paper detection actuator (15), transmits an image signal to a laser diode light-emitting unit (31) of the laser scanning section (30) so as to control on/off of the light-emitting diode (31).

The laser scanning section (30) includes the laser diode light-emitting unit (31), a scanning mirror (32), a scanning mirror motor (33), and reflecting mirrors (35, 36 and 37).

The scanning mirror (32) is rotated at a constant high speed by the scanning mirror motor (33). In other words, laser light (34) scans in a vertical direction to the paper surface of FIG. 1. The laser light (34) radiated by the laser diode light-emitting unit (31) is reflected by the reflecting mirrors (35, 36 and 37) so as to be applied to the photosensitive body (21). When the laser light (34) is applied to the photosensitive body (21), the photosensitive body (21) is selectively exposed to the laser light (34) in accordance with on/off information from the control circuit (17).

The image-forming device (20) includes the photosensitive body (21), a transfer roller (22), a charging member (23), a developing roller (24), a developing unit (25), and a cleaning unit (26). The surface charge of the photosensitive body (21), charged in advance by the charging member (23), is selectively discharged by the laser light. An electrostatic latent image is thus formed on the surface of the photosensitive body (21). The electrostatic latent image is visualized by the developing roller (24) and developing unit (25). Specifically, the toner supplied from the developing unit (25) is adhered to the electrostatic latent image on the photosensitive body (21) by the developing roller (24) so as to form the toner image.

Toner used for development is stored in the developing unit (25). The toner contains coloring components (such as carbon black for black toner) and thermoplastic components. The toner, charged by being appropriately stirred in the developing unit (25), adheres to the above-mentioned electrostatic latent image by an interaction of the developing biased voltage applied to the developing roller and an electric field generated by the surface potential of the photosensitive body (21), and thus conforms to the latent image, forming a visual image on the photosensitive body (21). The toner typically has a negative charge when it is applied to the latent image, forming the visual image.

Next, the sheet of recording paper (1) transported from the paper feed section (10) is transported downstream while being pinched by the photosensitive body (21) and the transfer roller (22). The paper (1) arrives at the transfer nip in time coordination with the toned image on the photosensitive body (21). As the sheet of recording paper (1) is transported downstream, the toner image formed on the photosensitive body (21) is electrically attracted and transferred to the sheet of recording paper (1) by an interaction with the electrostatic field generated by the transfer voltage applied to the transfer roller (22). Any toner that still remains on the photosensitive body (21), not having been transferred to the sheet of recording paper (1), is collected by the cleaning unit (26). Thereafter, the sheet of recording paper (1) is transported to the fixing device (50). In the fixing device (50), an appropriate temperature and pressure are applied while the sheet of recording paper (1) is being pinched by moving through the nip formed by a pressure roller (51) and the fixing roller or belt (52) that is maintained at an elevated temperature. The thermoplastic components of the toner are melted by the fuser belt (52) and fixed to the sheet of recording paper (1) to form a stable image. The sheet of recording paper (1) is then transported and ejected out of the printer by the printer transport rollers (41, 42).

Next, the operation of the fixing device (50) will be described in detail. The fixing device (50) includes the backup (or pressure) roller (51) and the fixing roller or fixing belt (52). The present invention relates to the embodiment where the fixing device (50) utilizes a fixing belt because it is in that context that the paper wrinkling issue poses a particular structural challenge. The fixing belt is generally an endless belt or tube formed from a highly heat-resistive and durable material having good parting properties and thickness of not more than about 100 $\mu$m, preferably not more than about 70 $\mu$m. Preferred belts are made from a polyimide film. The belt may have an outer coating of, for example, fluororesin or Teflon material to optimize release properties of the fixed toner from the belt. Such fuser belts are well known in the art. A heater, generally a flat ceramic heater, is held in place by a heater frame (together referred to as (54)) on the inside surface of the belt, and the outside surface of the belt forms a fusing nip with the backup roller (51) at the location of the heater. In other words, the heater (54) and the backup roller (51) form the nip, with the fuser belt (52) interposed between them. The pressure between the heater, the fuser belt and the backup roller forms the fusing nip. It is this pressure which sometimes wrinkles or "trees" the printed page as it goes through the nip. Each page carrying the toner travels through this nip (i.e., between the fuser belt (52) and the backup roller (51)) and the toner is fixed on the page through the combination of applied heat, pressure and the time the media is in the fuser nip. Typically, the pressure between the fuser belt (52) and the backup roller (51) at the fuser nip is from about 5 to about 30 psi. While the fuser belt (52) may be driven itself, often this is not the case. Generally, the backup roller (51) is rotated and it is the friction between the surface of the backup roller (51) and the printed page and ultimately the surface of the fuser belt (52), which causes the fuser belt (52) to rotate.

The backup or pressure roller (51) is cylindrical in shape. It is made from or is coated with a material that has good release and transport properties for the recording paper (1). The backup roller (51) is sufficiently soft so as to allow it to be rotated against the fuser belt (52) to form a nip through which the printed pages travel. By going through this nip, printed pages are placed under pressure and the combined effects of this pressure, the time the page is in the nip, and the heat from the fuser belt (52) acts to fix the toner onto the paper. Preferred materials for use in forming the backup roller (51) include silicone rubber, polyurethane and mixtures thereof, most preferably silicone rubber. The roller typically has an aluminum core with a silicone rubber layer molded or adhesively bonded onto its surface. This roller may also have a fluoropolymer (e.g., Teflon) sleeve or coating.

Figure 2:
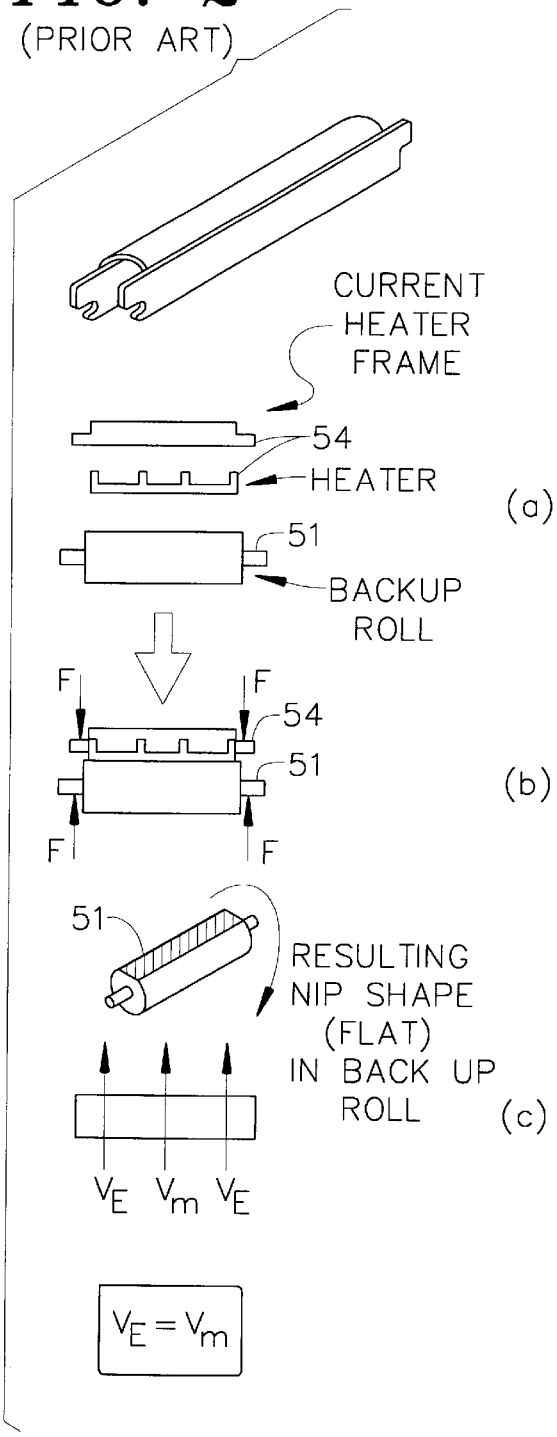
FIG. 2 (PRIOR ART)
FIG. 2 is an enlarged blow-up version of a typical fuser belt apparatus of the prior art.

Detail of a typical prior art fuser nip construction is shown in FIG. 2 of the present application. A typical heater frame for use in a fuser nip construction is shown in (a) of that figure. When the heater frame, the heater and the backup roller come together to form the fusing nip, as shown in (b), that nip has a relatively rectangular configuration across the length of the backup roller as shown in (c) of FIG. 2. Because the dimensions of this nip (i.e., the width of the nip) are substantially uniform across the nip, the velocity of the paper traveling through the nip is relatively constant at all points across the nip.

Figure 3:
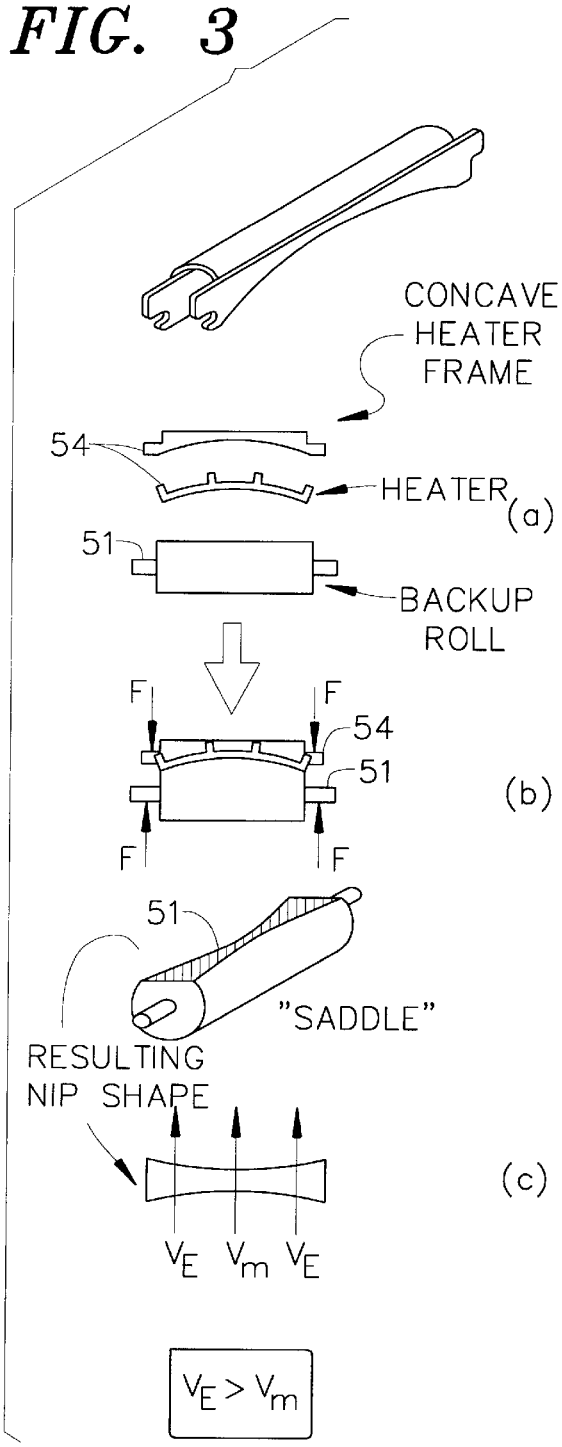
FIG. 3 is an enlarged blow-up version of fuser belt apparatus of the present invention, showing the manner in which it operates to minimize wrinkling of the printed page.

In contrast, a preferred embodiment of the present invention is shown in FIG. 3 of the present application. In that figure, the heater frame is concave on its side that faces the fuser nip (see (a)). When the fuser nip is formed by placing the heater frame, the heater and the backup roller together under pressure, the nip has a configuration such as that shown in (b) of FIG. 3 (the elastomeric material on the backup roller being flattened by the pressure from the heater frame). The cross-section of the nip formed on the backup roller is saddle-shaped in configuration. See (c) of FIG. 3. Since the width at the ends of the nip area is greater than the width at the center of the nip area, the velocity of the printed page through the nip at the ends (VE) is greater than the velocity of the printed page at the middle of the nip (VM). This differential between the end velocities and the middle velocity provides a force on the printed page which is normal to the direction of travel of the printed page through the nip and which stretches the printed page from the center of the nip outwards toward the ends of the nip. It is this force which acts to minimize the formation of wrinkles in the page. It is preferred that the concavity of the concave surface of the heater frame be from about 0.2 to about 0.4 mm, more preferably about 0.3 mm.

In order to assess the tendency of a fuser structure to "tree", two test methods were devised:

The first method involves printing test pages under controlled conditions and then evaluating the pages for occurrences of "trees" and assigning a "treeing performance"score to the set. The "treeing performance" score is indicative of the overall severity of wrinkles or "trees" in a set of pages. Lower scores indicate fewer and/or small wrinkles; thus, a lower score is preferable.

The second method involves measuring the spread of a page as it passes through the fuser. Using 8.5"×11" paper, a slit is made down the center of the paper, starting 5" from the leading edge and continuing to the trailing edge. This page is then fed into the fuser with the slit portion at the trailing edge. The fuser is stopped just before the trailing edge enters the nip. The resulting spread of the paper slit at the trailing edge is measured with a pair of calipers.

Testing of several different fusers indicates a relationship between "paper spread" and "treeing performance" with a larger spread resulting in better "treeing performance". The second method is preferable for conducting screening tests since it does not require the strict controls in the environment and media conditions required in the first test. The first method can be used to confirm screening tests as required.

Figure 4:
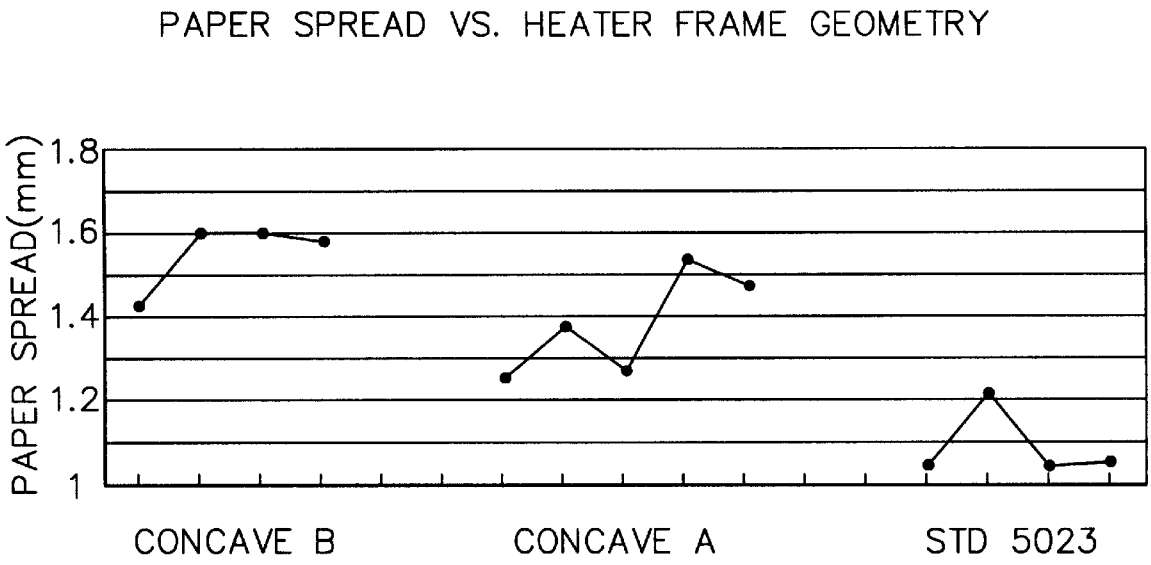
FIG. 4 is a graph demonstrating the effects of the lateral force provided by the present invention.
Figure 5:
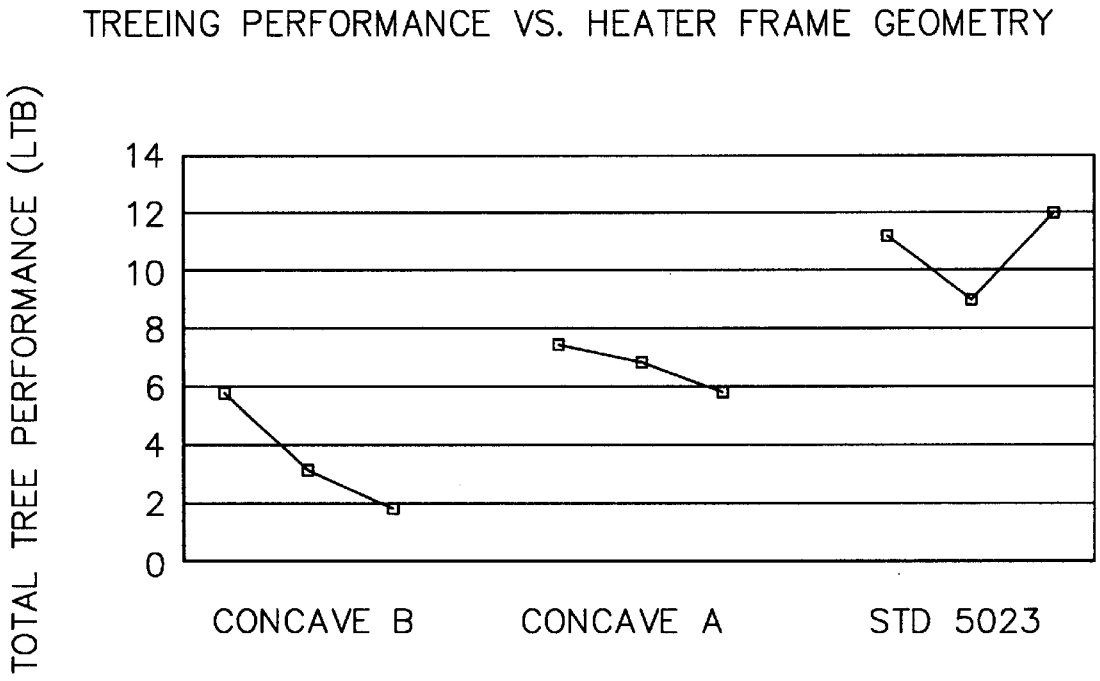
FIG. 5 is a graph demonstrating the wrinkle reduction on the printed page provided by the present invention.

Using the methods described above, two heater frames were modified to produce differing profiles of concavity and were labeled concave A and concave B. Concave B was profiled to have a greater effect on the nip pressure profile than concave A. Beginning at the center of the frame and moving toward each end, the Concave A frame was flat within the first 65 mm, then contained 0.23 mm concavity within the region from 65 mm to 102 mm from the center. The Concave B frame was flat within the first 38 mm, then contained 0.27 mm concavity within the region from 38 mm to 95 mm from the center of the frame. Results of test methods 1 and 2 for these frames are shown in FIGS. 4 and 5 of the present application, along with results for a standard unmodified frame. All frames were installed in the same fuser for testing so that all hardware was consistent except for the frame.

As shown in FIG. 4, paper spread is a function of the concavity profile of the heater assembly. Referring to FIG. 5, the "treeing performance" is improved by about a factor of 3 from the standard frame to concave B frame. The data provided pertain to the described embodiment of concave heater and uniform backup roll. However, other embodiments are possible and would fall within the scope of the present invention. For example, a flat heater can be used in combination with a concave backup roller. Any other combination of heater and backup roller that produces increasing nip pressure from the center toward the ends of nip may also be used. Profiling of the heater frame to achieve improvements in "treeing performance" must be done judiciously so as not to create other problems. For example, the nip width and residence time must be maintained within acceptable limits as dictated by fuse grade requirements.

The illustrations shown in the present application are only intended to be illustrative of the present invention and not limiting thereof. The full scope of the present invention is defined by the following claims and equivalents thereof.

What is claimed is:

1. An image-fixing apparatus comprising:

a concave heater which is stationary in use mounted in a concave heater frame;

a film slideable on said heater;

a driven cylindrical roller having a substantially uniform diameter, said frame pressing against said roller to form a nip, with said film being interposed between said backup member and said heater, wherein an image carried on a recording medium is heated through said film while in the nip by heat from said heater;

wherein said nip is saddle-shaped, being wider at its ends than at its center such that as the recording medium moves through the nip the velocity of the recording medium through the nip is greater at the ends of the nip than at the center of the nip, thereby providing a lateral force, from the center of the nip toward the ends of the nip, which is normal to its direction of travel through the nip.

2. The image-fixing apparatus according to claim 1 wherein at least the outer layer of the backup member is made from an elastomeric material which is flattened when the nip is formed.

3. The image-fixing apparatus according to claim 2 wherein the concavity of the concave portion of the heater frame is from about 0.2 to about 0.4 mm.

4. The image-fixing apparatus according to claim 3 wherein the heater is a ceramic heater.

5. The image-fixing apparatus according to claim 4 wherein the film is a polyimide belt having a thickness of no greater than about 100 $\mu$m.

6. The image-fixing apparatus according to claim 5 wherein the elastomeric material on the backup material is silicone rubber.

7. The image-fixing apparatus according to claim 3 wherein the concavity of the concave portion of the heater frame is about 0.3 mm.

8. The image-fixing apparatus according to claim 2 wherein the elastomeric material on the backup member is selected from the group consisting of silicone rubber, polyurethane, and mixtures thereof.

9. The image-fixing apparatus according to claim 8 wherein the elastomeric material on the backup member is silicone rubber.

* * * * *